US012025358B2

(12) United States Patent
Schoonen

(10) Patent No.: US 12,025,358 B2
(45) Date of Patent: Jul. 2, 2024

(54) EFFICIENT CLEAR ICE CUBE PRODUCTION

(71) Applicant: W. Schoonen Beheer B.V., Nuenen (NL)

(72) Inventor: Wilhelmus Franciskus Schoonen, Nuenen (NL)

(73) Assignee: W. Schoonen Beheer B.V., Nuenen (NL)

( * ) Notice: Subject to any disclaimer, the term of this patent is extended or adjusted under 35 U.S.C. 154(b) by 217 days.

(21) Appl. No.: 16/634,586

(22) PCT Filed: Jul. 30, 2018

(86) PCT No.: PCT/EP2018/070626

§ 371 (c)(1),
(2) Date: Jan. 28, 2020

(87) PCT Pub. No.: WO2019/025381

PCT Pub. Date: Feb. 7, 2019

(65) Prior Publication Data

US 2020/0173706 A1 Jun. 4, 2020

(30) Foreign Application Priority Data

Jul. 31, 2017 (EP) ..... 17184004

(51) Int. Cl.
*F25C 1/10* (2006.01)
*F25C 5/04* (2006.01)

(52) U.S. Cl.
CPC . *F25C 1/10* (2013.01); *F25C 5/04* (2013.01)

(58) Field of Classification Search
CPC ..... F25C 1/10; F25C 5/04
(Continued)

(56) References Cited

U.S. PATENT DOCUMENTS 2,156,954 A * 5/1939 Nelson ..... F25B 37/00 62/110
2,959,033 A * 11/1960 Raver ..... F25C 1/142 62/347

(Continued)

FOREIGN PATENT DOCUMENTS

CN 101779089 A 7/2010
EP 2807931 A1 * 12/2014 ..... F25C 1/04

(Continued)

OTHER PUBLICATIONS

"Plastic mould design and manufacturing", Zhang, Hongfeng, pp. 139-140, Henan Science and Technology Press, Aug. 2006—in Chinese—Office Action detailing the content attached.

*Primary Examiner* — Eric S Ruppert
*Assistant Examiner* — Kirstin U Oswald
(74) *Attorney, Agent, or Firm* — N.V. Nederlandsch Octrooibureau

(57) ABSTRACT

An apparatus for making ice cubes that comprises at least one elongated mould (102) that defines a space (117) for an ice column, which space (117) is at least substantially closed at least while a liquid substance is being refrigerated. A supplying device (118) is provided for supplying the liquid substance to the at least one elongated mould (102). A refrigerating device (111) is provided for freezing the liquid substance inside the at least one elongated mould (102) An elongated element (101) is configured to extend through said at least one mould (102) in a longitudinal direction of said at least one mould (102). The elongated element (101) is configured to rotate around a longitudinal axis of the elongated element (101).

17 Claims, 6 Drawing Sheets

(58) Field of Classification Search
USPC ..... 62/66
See application file for complete search history.

(56) References Cited

U.S. PATENT DOCUMENTS 3,274,792 A * 9/1966 Weil ..... F25C 1/145 62/320
3,430,452 A * 3/1969 Dedricks ..... F25C 1/12 62/347
3,618,335 A * 11/1971 Toma ..... F25C 5/08 62/349
4,547,076 A * 10/1985 Maurer ..... A23G 9/045 62/307
8,677,774 B2 * 3/2014 Yamaguchi ..... F25C 1/12 62/340
10,066,861 B2 * 9/2018 Gooden ..... F25C 5/06
2005/0160757 A1 * 7/2005 Choi ..... F25C 1/10 62/344
2009/0308085 A1 * 12/2009 DeVos ..... F25C 1/10 62/73
2010/0269534 A1 * 10/2010 Kumakiri ..... F25B 39/02 62/346
2014/0165623 A1 * 6/2014 Guarino ..... F25C 1/24 62/340
2016/0131406 A1 * 5/2016 Schoonen ..... F25C 1/06 62/340
2017/0363338 A1 * 12/2017 Jensen ..... F25C 1/22

FOREIGN PATENT DOCUMENTS

JP 59-62477 U 4/1984
JP S59-62477 4/1984
KR 101491491 B1 * 2/2015
WO 2011/059333 A2 5/2011
WO 2014/193222 A1 12/2014
WO WO-2016055495 A2 * 4/2016 ..... F25C 1/04

* cited by examiner

EFFICIENT CLEAR ICE CUBE PRODUCTION

FIELD OF THE INVENTION

The invention relates to an apparatus and method for clear ice cube production.

BACKGROUND OF THE INVENTION

Ice cubes can be mass produced, for delivery to catering industry and supermarkets, for example. Moreover, in a café or restaurant, ice cubes may be created on the spot.

WO 2009/005339 A2 discloses a device and a method for making ice cubes, comprising a supplying device for supplying a liquid substance to at least one elongated mould and a refrigerating device for freezing said liquid substance, which at least one mould defines a space for an ice column which is at least substantially closed at least while said liquid substance is being refrigerated. The at least one mould comprises two mould halves which are movable relative to each other, so that the mould halves can be moved apart once the ice column has been formed. The document further discloses a method for making ice cubes, comprising the steps of supplying a liquid substance to a mould comprising an at least substantially closed space, freezing the liquid substance in the mould, and removing the ice cubes thus formed from the mould.

WO 2014/193222 A1 discloses an apparatus for making ice cubes, for example in a café or restaurant to provide a continuous supply of ice cubes, wherein the apparatus comprises a plurality of elongated elements. A plurality of mould parts are movable with respect to the elongated elements. The plurality of mould parts are movable to form a mould around a first elongated element of the elongated elements. A control unit is configured to control a movement of the plurality of mould parts with respect to the elongated elements to move the mould parts forming the mould around the first elongated element apart once a first ice column has been formed in the mould, and form a mould around a second elongated element of the elongated elements. An ice remover is configured to remove the first ice column.

SUMMARY OF THE INVENTION

It is an object to provide an improved device for making ice cubes.

To address this concern, in a first aspect, the invention provides an apparatus for making ice cubes, comprising

- at least one elongated mould that defines a space for an ice column, which space is at least substantially closed at least while a liquid substance is being refrigerated;
- a supplying device for supplying the liquid substance to the at least one elongated mould;
- a refrigerating device for freezing the liquid substance inside the at least one elongated mould;
- an elongated element configured to extend through said at least one mould in a longitudinal direction of said at least one mould;
- wherein the elongated element is configured to rotate around a longitudinal axis of the elongated element.

The rotation of the elongated element causes a circulation of the liquid substance within the mould. This provides a continuous motion of the liquid substance, which causes the refrigerated substance to contain less contamination with, for example, gases such as encapsulated environmental air. This can make the ice cubes more clear.

For example, the rotation of the elongated element causes the liquid substance to circulate around the elongated element. This may be realized by providing sufficient space between the elongated element on all sides of the elongated element. This way, the elongated element generates a centrifugal motion of the liquid substance. This centrifugal motion forces the liquid substance towards the walls of the mould. Since the liquid substance typically has a greater mass density than gases, such as the gases included in environmental air, while the liquid substance is forced towards the walls of the mould, the gases concentrate around the elongated element.

At least part of the surface of the elongated element may be course, bristly, or uneven. This provides more friction between the liquid substance and the surface of the elongated element, thereby improving the rotation motion of the liquid substance.

For similar reasons, the surface of the elongated element may have at least one protrusion and/or at least one recess.

An actuator may be operatively coupled to the elongated element. This allows to control the rotation of the elongated element.

For example, the actuator may be configured to cause the elongated element to rotate at least during a part of the time during which the liquid substance is being refrigerated. This allows the ice cube to become clear, while power may be saved by stopping rotation when it is not necessary.

A wall of the mould, at an end of the mould in the longitudinal direction, preferably at a top of the mould, may comprise an orifice through which the elongated element is configured to extend. This allows the gases, which may be concentrated around the elongated element, to escape through the orifice. Moreover, it allows the mechanical coupling between actuator and elongated element to be outside the mould.

The orifice in the wall of the mould may be at least partly covered with a flexible solid material. This is a suitable material to reduce friction between mould and elongated element.

An inside surface of the mould may comprise a recess at an end of the mould in the longitudinal direction, preferably at a bottom of the mould, wherein the recess is configured to receive a tip of the elongated element. This allows to rotate the elongated element with the tip of the elongated element fixed in the recess, so that the elongated element does not move around but merely rotates stationary.

The recess may comprise a flexible solid material, which flexible solid material may contact the tip of the elongated element. This may allow for smooth rotation. For example, the flexible solid material comprises a gasket. The flexible solid material may be, for example, rubber or silicon rubber, or a plastic or synthetic material.

The tip may correspond to a first end of the elongated element. The actuator may be mechanically coupled to a second end of the elongated element, wherein the first end is opposite to the second end. Since the mechanical coupling is provided at the second end, no actuation is necessary at the first end of the elongated element. Therefore, the space for the ice column may be entirely closed at the end of the mould that receives the tip of the elongated element. For example, the bottom side of the mould may be entirely closed.

At least part of an inside surface of the mould may comprise a metal, such as aluminium. This material allows the refrigeration to be relatively quick and/or efficient.

Said at least one mould may define a series of interconnected, hollow spaces for forming an elongated ice column of interconnected ice cubes. This allows a large number of ice cubes to be connected to each other, which facilitates handling of the ice cubes.

The apparatus may comprise a plurality of moulds which are oriented in a matrix relative to each other. This allows large numbers of ice cubes to be produced at one time. Moreover, at least some moulds of this plurality of moulds may be interconnected by means of channels that can fill with liquid substance that is frozen, so that the ice columns may be interconnected too. This way, a plate of interconnected ice cubes in a grid pattern may be produced.

According to another aspect, a method of making ice cubes is provided. The method comprises supplying a liquid substance to at least one elongated mould that defines a space for an ice column, which space is at least substantially closed at least while the liquid substance is being refrigerated;

freezing the liquid substance inside the at least one elongated mould, while rotating an elongated element extending through the mould in a longitudinal direction of the mould around a longitudinal axis of the elongated element; and removing the ice column thus formed from the mould.

The person skilled in the art will understand that the features described above may be combined in any way deemed useful. Moreover, modifications and variations described in respect of the system may likewise be applied to the method and to a computer program product, and modifications and variations described in respect of the method may likewise be applied to the system and to a computer program product.

BRIEF DESCRIPTION OF THE DRAWINGS

In the following, aspects of the invention will be elucidated by means of examples, with reference to the drawings. The drawings are diagrammatic and may not be drawn to scale. Throughout the figures, similar items may be marked with the same reference numerals.

DETAILED DESCRIPTION OF EMBODIMENTS

Certain exemplary embodiments will be described in greater detail, with reference to the accompanying drawings.

The matters disclosed in the description, such as detailed construction and elements, are provided to assist in a comprehensive understanding of the exemplary embodiments. Accordingly, it is apparent that the exemplary embodiments can be carried out without those specifically defined matters. Also, well-known operations or structures are not described in detail, since they would obscure the description with unnecessary detail.

The present invention, according to a first aspect thereof, relates to a device for making ice cubes. The term "ice" as used herein refers to a frozen substance. The term is not limited only to frozen water or a frozen liquid, but it also encompasses frozen liquid substances such as foodstuffs, for example a puree. For the sake of briefness, the term "ice" is used herein to indicate the collection of frozen substances.

Figure 1:
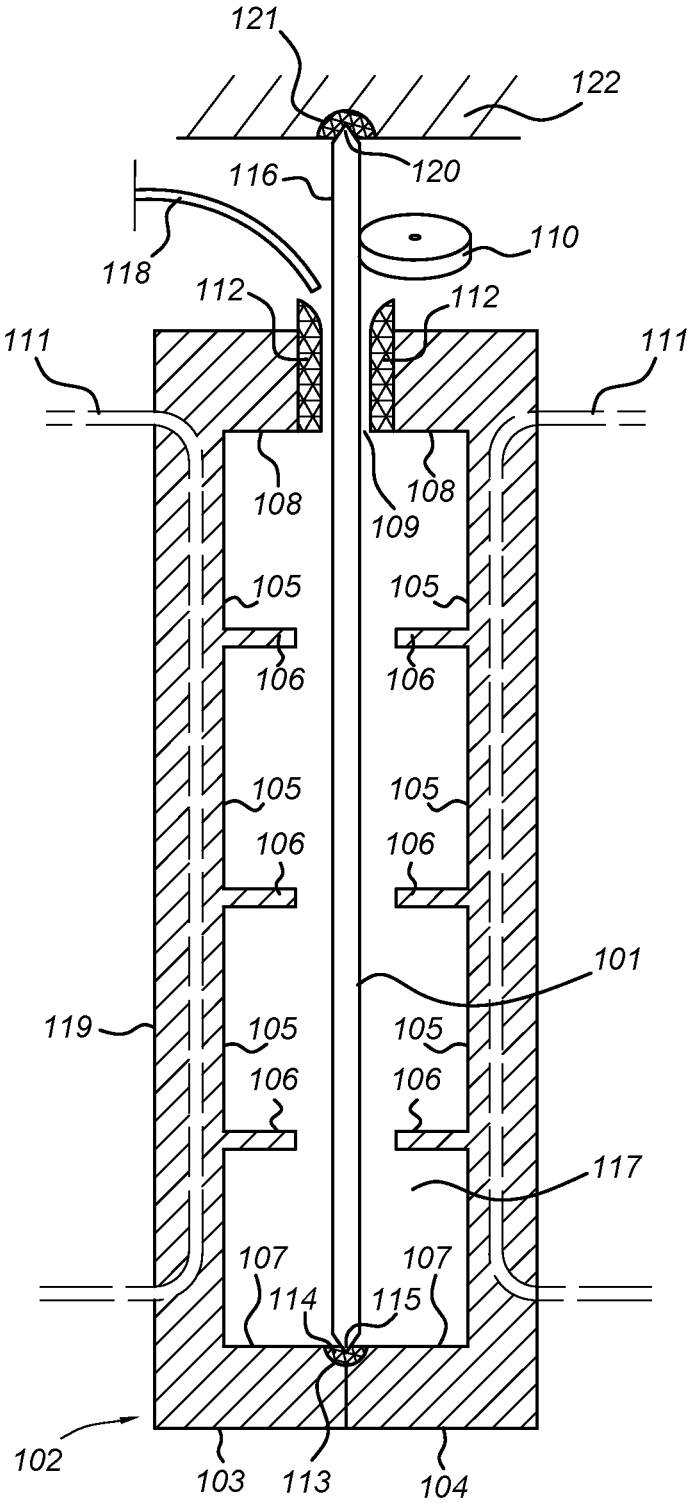
FIG. 1 is a schematic, longitudinal section view of a mould in closed position.

FIG. 1 shows a mould in longitudinal section view. The mould 102 may comprise two mould halves 103, 104, which are movable relative to each other, so that the mould halves can be moved apart once the ice column has been formed. As a result, the ice column can be easily removed from the mould by moving said mould halves, which are movable relative to each other, away from the ice column.

The mould 102 can be extended to have multiple, similar movable parts 103, 104 and/or elongated elements 101. Examples of this extension are shown in and described with reference to FIG. 5 and FIG. 6. The elongated element 101 is mechanically coupled to an actuator 110. The actuator 110 may comprise a motor, such as an electromotor (not shown), for example. The actuator 110 further may comprise a wheel (as illustrated) that touches the side of the elongated element to convey a rotary movement from the wheel to the elongated element. The rotary movement of the wheel may be powered by the motor. The rotary movement of the elongated element 101 may cause a rotating movement of the liquid substance around the elongated element 101 inside the mould 102.

The elongated mould 102 defines a space 117 for an ice column, which space 117 is at least substantially closed at least while a liquid substance is being refrigerated. For example, when the mould is substantially closed, the mould may be configured to be closed at the bottom and the sides, while allowing a liquid substance to be supplied into the mould through an opening at the top of the mould.

Although the mould may comprise two or more mould halves 103, 104, this is not a limitation. Other means to remove the ice column from the mould 102 may be implemented. For example, one side of the mould may be implemented in form of a valve that closes one side of the mould during the freezing, and opens afterwards. By heating the walls of the mould, the ice column may detach from the walls and slide through the opening out of the mould. The elongated element may be heated also, at the same time of heating the walls, to improve detachment of the ice column from the elongated element. For example the valve may cover the bottom side of the mould, so that the ice column can easily slide out of the mould making use of gravitation. This should work particularly well when the ice column has a convex shape.

Returning to FIG. 1, the apparatus may comprise a supplying device 118 for supplying the liquid substance to the at least one elongated mould 102. This supplying device 118 may be, for example, a tube connected at one end to a reservoir or pump, to transport the liquid substance into the mould 102.

A refrigerating device 111 is provided for freezing the liquid substance inside the at least one elongated mould 102. The refrigerating device 111 is shown in FIG. 1 as a tube 111 that is partially inside the wall of the mould 102. Through the tube 111, a cold fluid may be circulated to refrigerate the liquid substance inside the mould 102. Both ends of the tube 111 may be fluidly connected to a refrigerator. Alternatively, the refrigerating device may be implemented in any was known in the art.

The elongated element 101 extend through the mould 102 in a longitudinal direction of the mould 102. In the drawing, the elongated element 101 protrudes from the mould, so that a portion 116 of the elongated element 101 is outside of the mould. This implementation example shows how the elongated element 101 may be mechanically coupled to the actuator 110. Also, it is possible that the elongated element 101 protrudes from the mould 102 on the bottom side 114 of the mould (not illustrated). Some care should be taken to prevent too much leakage of liquid substance from the mould 102 in that case.

The elongated element 101 is configured to rotate around a longitudinal axis of the elongated element 101. The rotation of the elongated element 101 may last during at least a part of a time during which the liquid substance is being refrigerated. The timing of the rotation, or the rotation speed, may be controlled using, for example a control unit, such as a computer processor, or a dedicated electronic circuit. Such a control unit can control rotation of the elongated element by operation of the actuator 110, at the same time the refrigeration using the refrigeration device 111 takes place. Based on a timer or based on, for example, a temperature measurement, the refrigeration may be stopped and heating of the mould walls may be started. For example, the rotation of the elongated element 101 can be continued until the ice column has been removed from the mould, to prevent the elongated element 101 from freezing to the ice column.

In certain embodiments, at least a portion 116 of the elongated element 101, where the actuator 110 contacts the elongated element 101, is cylindrical and/or has a smooth surface, to improve the actuation. Alternatively, a wheel (not shown) may be fixed to the elongated element, so that the elongated element 101 is the axis of the wheel, and the wheel may be used to control the rotation. For example, that wheel may be a gear wheel.

The elongated element 101 may be cylindrical in shape. However, this is not a limitation. The cross section of the elongated element 101 may have any predetermined shape. For example, a polygonal shape of the cross section may provide increased amount of stirring during the rotation.

The surface of the elongated element may be smooth. That facilitates removal of the ice column from the elongated element. The surface of the elongated element may also be at least partially coarse, bristly, or uneven. This may improve the stirring effect of the rotational movement.

Although the elongated element 101 may be rotated effectively by a mechanical actuator, it will be understood that, since the elongated element is rotatable around its longitudinal axis, the elongated element 101 may alternatively be rotated by manual handling of the elongated element 101.

As illustrated in FIG. 1, a wall 108 of the mould 102 at the top of the mould can comprise an orifice 109 through which the elongated element 101 can extend during the freezing phase. This allows easy handling of the elongated element for rotating the elongated element.

To make the rotation easier, the contact areas where the elongated element 101 touches the mould 102 may be covered with a flexible solid material, such as a plastic or a resin material. This material may applied to the surface of the elongated element 101 or to the surface of the mould 102. In the drawing, the flexible solid material 112 has been provided on the circumference of the orifice 109.

Shown in FIG. 1, the inside surface 107 of the mould 102 comprises a recess 113 at a bottom end of the mould. The recess 113 can receive the tip 115 of the elongated element 101. By forcing the tip 115 of the elongated element 101 into the recess 113, the elongated element 101 is rotatably fixed in the mould 102. The other end 120 of the elongated element 101, on the opposite side of the tip 115, may be rotatably fixed in another recess 121 in a fixed surface 122 outside of the mould 102. The surface 122 may be biased towards the recess 113. Either one of or both recesses 113 and 121 may comprise a flexible solid material 114. This may facilitate the rotation.

The walls 119 of the mould 102 may be made of any suitable material, such as a metal. Suitable metal is, for example, aluminium or stainless steel. The outside of the mould may be optionally covered by a thermally isolating material (not illustrated).

The mould 102 may define spaces for interconnected ice cubes that are separated by walls 106. These walls 106 may also be made of a metal such as aluminium or stainless steel, for example.

Figure 2:
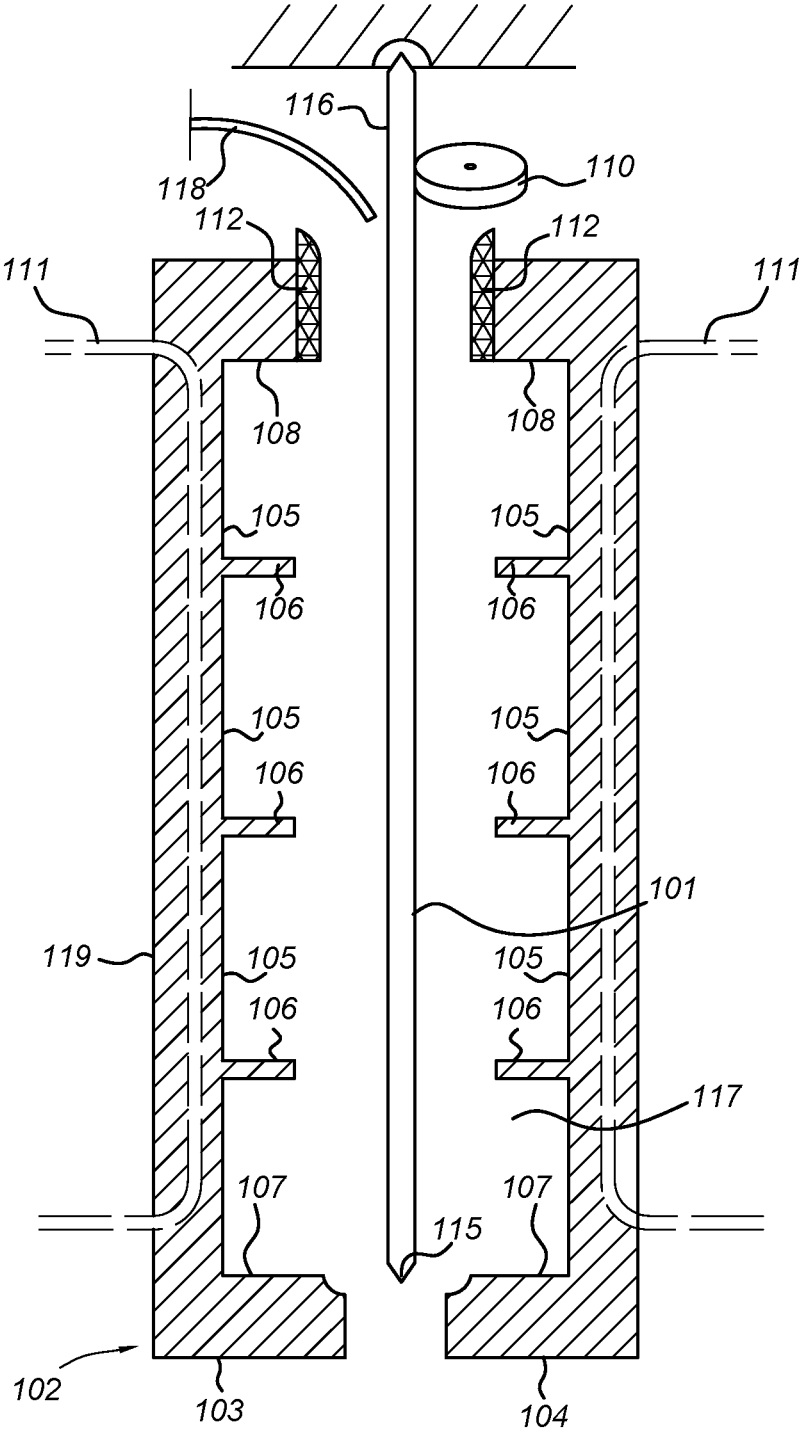
FIG. 2 is a schematic, longitudinal section view of the mould of FIG. 1 in open position.

FIG. 2 shows the same mould as in FIG. 1, with the difference that the mould halves 103, 104 are in a position apart from each other. Thus, the ice column may be removed from the elongated element by sliding it along the elongated element, for example in a downward direction. For example, because of the rotating movement, the ice column has not frozen to the elongated element 101 and slides easily along the elongated element 101.

Referring to both FIG. 1 and FIG. 2, the apparatus may be configured to rotate the elongated element at different speeds. For example, during a cycle of supplying the liquid substance into the mould, freezing the liquid substance, optional heating of the mould to detach the ice column from the mould, and removing the ice column from the mould and removing the ice column from the elongated element, the apparatus may apply differently chosen rotation speeds. For example, the process may begin with a relatively slow rotation, until the mould reaches a temperature of about zero degrees. At that point, a thin ice layer may have formed on the inside surface of the mould, providing a smooth surface for rotation, for example at the recess 113 in the surface 107 of the mould 102, which touches the tip 115 of the elongated element.

Moreover, after the refrigeration is finished, because sufficient amount of liquid substance has frozen inside the mould, the mould may be optionally heated, for example by circulating a hot fluid through the tube 111 inside the mould wall. During this time of heating the rotation speed may be smaller than during the time of freezing. This may avoid breaking of the ice column after it is detached from the mould. Moreover, this rotation speed during heating may still be greater than the rotation speed applied before the mould reaches a temperature of zero degrees Celsius.

After the ice column has been removed from the mould, or when sliding the ice column from the mould, a lower rotation speed may be applied, for example a rotation speed that is equal to or lower than the rotation speed applied before the mould reached zero degrees Celsius.

The apparatus may comprise a temperature sensor to detect a temperature of the mould, and the actuator may be configured to cause the elongated element to rotate at a first rotation speed when the detected temperature is above zero degrees Celsius, and at a second rotation speed when the detected temperature is below zero degrees Celsius, wherein the second rotation speed is higher than the first rotation speed.

The actuator may be configured to continue causing the elongated element to rotate after the freezing is completed.

The apparatus may comprise a heating device configured to cause heating of at least part of the mould after the freezing is completed, wherein the actuator is configured to cause the elongated element to rotate at a second rotation speed at a time of freezing the ice column, and at a third rotation speed when heating the at least part of the mould, wherein the second rotation speed is lower than the first rotation speed.

The actuator may be configured to cause the elongated element to rotate at a fourth rotation speed at a time of freezing the ice column or heating the mould, and at a fifth rotation speed after freezing and optional heating has completed, wherein the fourth rotation speed is greater than the fifth rotation speed.

In a specific example, the apparatus starts rotating the elongated element at about 500 rotations per minute when the refrigeration is started. Then, when the temperature of the mould is below a predetermined temperature threshold, such as zero degrees Celsius, rotation of the elongated element is continued with about 2500 rotations per minute. After refrigeration has finished, during detachment of the ice column from the mould by heating, rotation of the elongated element is continued at about 1200 rotations per minute. After detaching the ice column from the mould, the rotation may be continued at about 300 rotations per minute or lower. When the ice column remains on the elongated element for a longer period of time, for example in an apparatus for making ice cubes, for example in a café or restaurant to provide a continuous supply of ice cubes, as disclosed in WO 2014/193222 A1, the rotation may be continued at a lower rate, for example 100 rotations per minute. These values are merely provided herein as examples.

Figure 3:
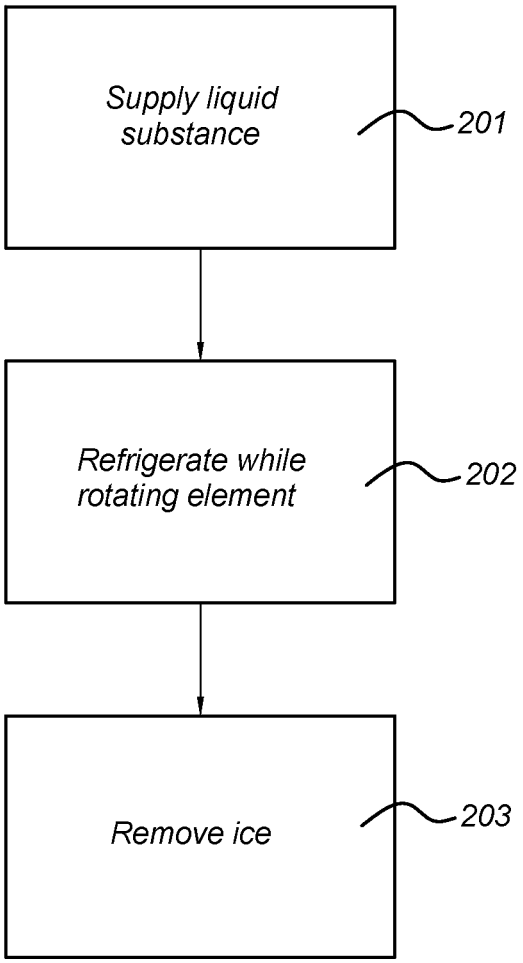
FIG. 3 is a flowchart depicting a method of making ice cubes.

FIG. 3 shows a method of making ice cubes. At step 201, a liquid substance is supplied to at least one elongated mould that defines a space for an ice column, which space is at least substantially closed at least while the liquid substance is being refrigerated. At step 202, the liquid substance is frozen inside the at least one elongated mould, while rotating an elongated element extending through the mould in a longitudinal direction of the mould around a longitudinal axis of the elongated element. In step 203, the ice column thus formed is removed from the mould.

In order to be able to produce more than one ice cube in each mould, it is preferable if said at least one mould defines a series of interconnected, hollow spaces for forming an elongated ice column of interconnected ice cubes. Since the ice cubes are interconnected in a way defined by the shape of the mould, they can be packaged and oriented in an efficient manner upon use. The interconnection between ice cubes can vary from a minimum connection to a connection over the entire area of the side-by-side surfaces, so that an elongated column is obtained, as it were, in which the individual ice cubes cannot be distinguished. In fact, ice cubes of variable length can be broken or cut off from such a column.

The mould may therefore have a continuous inner surface so as to produce a bar of ice that can subsequently be divided into separate ice cubes, but it is preferable if the mould comprises reduced diameter portions so as to form reduced diameter portions in the elongated ice column between adjacent ice cubes. As a result, it will be easier to separate individual ice cubes from each other upon subsequent use of the ice cubes than in the case of a continuous mould as described at the beginning of this paragraph.

Alternatively, said at least one mould may define a series of individual hollow spaces for forming an ice column of a plurality of individual ice cubes. The advantage of this is that the ice cubes need not be separated from each other at a later stage, at least if the ice cubes are prevented from freezing together yet during subsequent storage.

An elongated element extends through said at least one mould in the longitudinal direction of said at least one mould. Around the elongated element the ice cubes are formed in the mould. It may be desirable to form cavities in ice cubes, for example in order to be able to manipulate the ice cubes at a later stage and/or enlarge the chilling area of the ice cubes. The cavity may be a through hole or a recess.

The elongated element may comprise heating means. Said heating means, too, may make it easier to detach the ice column quickly from the elongated element by melting, for example by first heating the mould, then moving the mould halves away from the ice column and subsequently heating the elongated element, so that the ice column can slide along the elongated element into a package.

Said at least one mould may be substantially vertically oriented. The advantage of this is that when the ice cubes are to be removed from the mould, for example by moving mould halves apart as described in the foregoing, the ice column or the individual ice cubes can fall straight down into a package. The elongated element can function as a guide for the ice column or the ice cubes.

In order to further increase the capacity, the device can comprise a row of moulds oriented side by side. Moreover, the device may comprise a number of moulds which are oriented in a matrix relative to each other. In this way a relatively compact device is obtained for producing ice cubes at a high capacity.

Conveying means may be provided for positioning a container under said at least one mould for collecting ice cubes formed by the device. In this way the ice cubes can be packaged in a correct and efficient manner, while it is possible to mechanise and/or automate the production process, so that no human operations are required. This makes it possible to work not only efficiently but also hygienically.

Moreover, pre-refrigerating means may be provided for pre-refrigerating a liquid substance to be supplied to said at least one mould. In general it can be stated that the colder the liquid substance that is supplied to said at least one mould, the more quickly said liquid substance can be converted into ice by further refrigeration in the mould and the more quickly the production cycle can be completed. This, too, leads to increased capacity of the device.

Refrigerating means may be provided in the mould, so that the liquid substance may be cooled and frozen by said at least one mould. As a result, the liquid substance is cooled and frozen directly in the mould, which leads to a relatively high output. The at least one mould may further comprise heating means for detaching the obtained ice column by melting.

In order to be able to produce more than one ice cube in each mould, said at least one mould may define a series of interconnected, hollow spaces for forming an elongated ice column of interconnected ice cubes. Since the ice cubes are interconnected in a way defined by the shape of the mould, they can be packaged and oriented in an efficient manner upon use. The interconnection between ice cubes can vary from a minimum connection to a connection over the entire area of the side-by-side surfaces, so that an elongated column is obtained, as it were, in which the individual ice cubes cannot be distinguished. In fact, ice cubes of variable length can be broken or cut off from such a column.

The mould may therefore have a continuous inner surface so as to produce a bar of ice that can subsequently be divided into separate ice cubes, but it is preferable if the mould comprises reduced diameter portions so as to form reduced diameter portions in the elongated ice column between adjacent ice cubes. As a result, it will be easier to separate individual ice cubes from each other upon subsequent use of the ice cubes than in the case of a continuous mould as described at the beginning of this paragraph.

Said at least one mould may define a series of individual hollow spaces for forming an ice column of a plurality of individual ice cubes. The advantage of this is that the ice cubes need not be separated from each other at a later stage, at least if the ice cubes are prevented from freezing together yet during subsequent storage.

Agitation means are provided for agitating the liquid substance while it is being refrigerated in said at least one elongated mould. The agitation may be performed by rotating the elongated element around its longitudinal axis. In addition, said agitation means may comprise a vibration device which sets said at least one mould and possibly other parts of the device vibrating during the refrigeration process.

Figure 4:
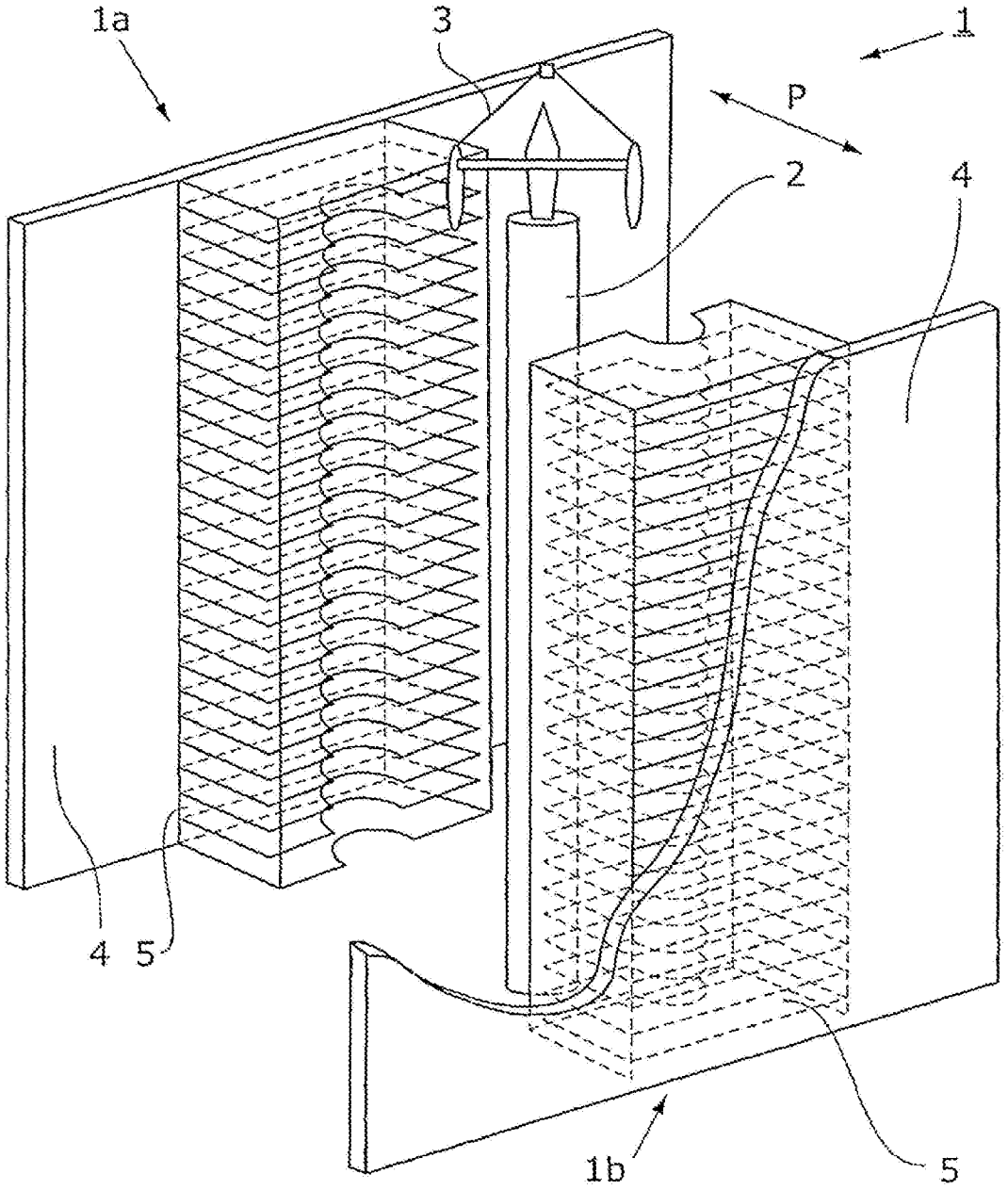
FIG. 4 is a schematic, perspective view of a mould for an ice column in an open condition thereof.

FIG. 4 shows a mould 1 for making ice cubes. The mould 1 comprises two mould halves 1*a*, 1*b*, which are movable relative to each other in the directions indicated by the arrow P, and an elongated element, in this case a tube 2 with a suspension system 3. The tube may be configured to rotate around its longitudinal axis, as described with reference to FIGS. 1 to 3. The mould halves 1*a*, 1*b* each comprise a plate 4 and a series of mould elements 5 arranged one above another. The mould 1 comprises two mould halves 1*a*, 1*b*, which are movable towards and away from each other in the directions indicated by the arrow P. In FIG. 4 the mould halves 1*a*, 1*b* are shown in a condition in which they are maximally apart. The mould halves 1*a*, 1*b* each comprise a plate 4, which is provided with mould elements 5 arranged one above another. In this example the mould elements 5 are rectangular in shape, provided with a semicircular recess so as to create space for the tube 2. In the position in which the mould halves 1*a*, 1*b* have been moved together (see FIG. 5), two opposing mould elements 5 form a space for an ice cube. The mould elements may be provided in such a manner as to be exchangeable, making it possible to use mould elements of varying shapes in the device according to the present invention. An elongated element 2, for example a tube, which is suspended from a suspension system 3, extends vertically between the two mould halves 1*a*, 1*b*.

Figure 5:
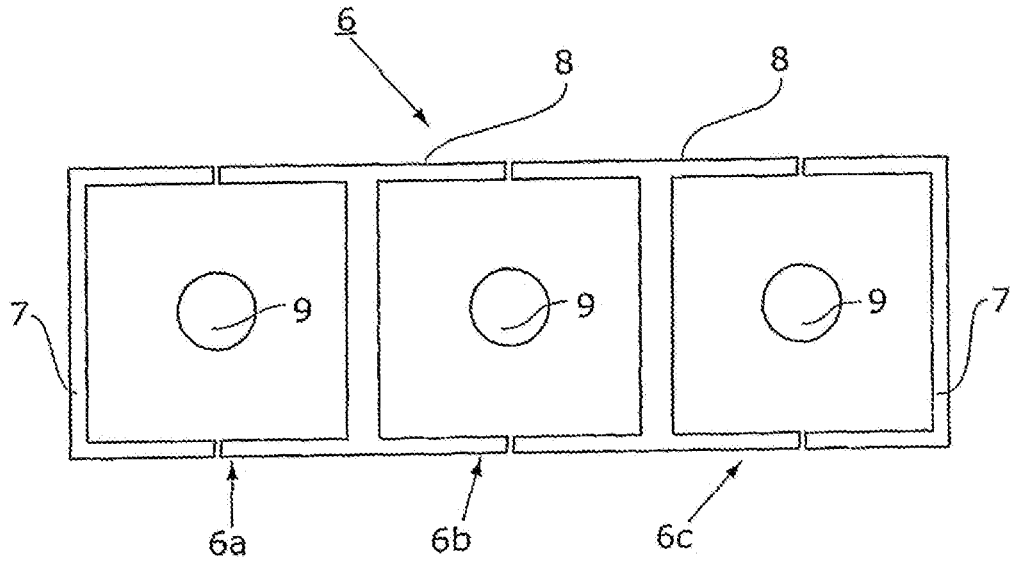
FIG. 5 is a schematic, cross-sectional view of a mould in closed position.

FIG. 5 is a cross-sectional view of an assembly 6 of three moulds 6*a*, 6*b*, 6*c* according to the principle illustrated in FIG. 4, which are made up of U-shaped sections 7 and H-shaped sections 8, through which tubes 9 extend. In FIG. 5 the moulds 6*a*, 6*b*, 6*c* are substantially closed, i.e. the mould halves have been moved together, thus forming one substantially closed space around respective tubes 9. In FIG. 5, the mould halves are made up of U-shaped sections 7 on the outer side and H-shaped sections 8 in the centre of the assembly 6. In this embodiment, for example, the middle tube 9 can remain stationary (except for the rotation around its axis). The H-sections 8 can be moved aside, away from the middle tube 9, and the outer tubes 9 can in turn be moved in outward direction, further away from the H-sections 8. The U-sections 7 can be moved even further outwards with respect to the outer tubes 9. In this way sufficient space is created around all the tubes 9 for removing ice columns formed in the moulds 6*a*, 6*b*, 6*c*.

Figure 6:
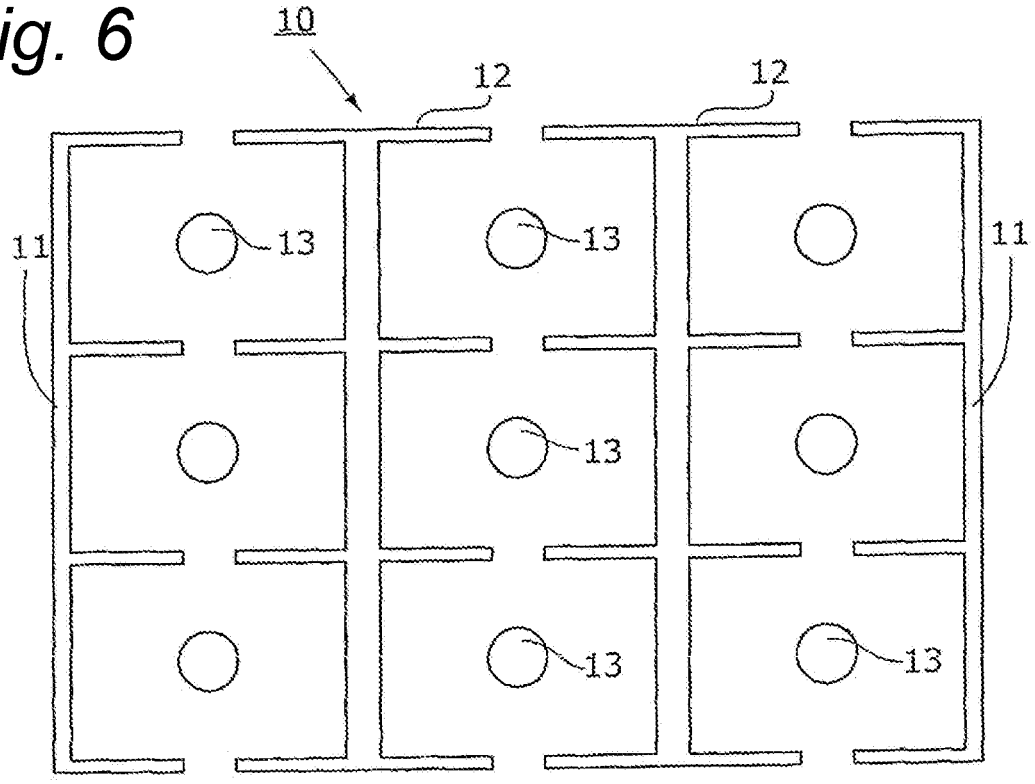
FIG. 6 is a schematic, cross-sectional view of a matrix of moulds in open condition.

FIG. 6 shows a matrix mould 10 comprising nine moulds according to the principle of FIG. 4, which are made up of section elements 11, 12, through which tubes 13 extend. Section elements 11 are located on the outer sides and section elements 12 are located in the centre of the matrix mould. The operating principle of the matrix mould 10 corresponds to that shown in FIG. 5. In FIG. 6 the section elements 11, 12 are shown in spaced-apart relationship, as in FIG. 4. As the figure shows, the spacing between the tubes is larger than in FIG. 5.

To produce ice columns by means of a matrix mould as shown in FIG. 6, the moulds may be substantially closed by moving the section elements 11 and 12 together, i.e. the section elements to the left of the middle column of tubes 13 are moved to the right as much as possible and the section elements 11, 12 to the right of the middle column of tubes are moved to the left as much as possible. The tubes 9 remain oriented approximately centrally between the section elements. Subsequently, water having a temperature near the freezing point is introduced into the moulds from the upper side of each mould. The moulds are closed at the bottom side, so that the moulds will fill with water. Once sufficient water has been introduced into the moulds, the section elements 11, 12 are refrigerated in a manner which is known per se, causing the water present in the moulds to freeze. When ice columns have thus been formed in the moulds, the section elements 11, 12 may be briefly heated, as a result of which the ice columns melt at their circumference, where they make contact with the section elements 11, 12, and the section elements 11, 12 can be moved apart to return to the position shown in FIG. 6.

In certain embodiments, the ice columns will remain in place after the section elements 11, 12 have moved apart, because the ice columns are frozen on to the tubes 13. Subsequently the tubes 13 may be heated, so that the ice columns melt at their inner circumference and become detached from the tubes 13.

In certain embodiments, the ice columns do not freeze fixed to the tubes 13, because the rotating movement of the tubes prevents the ice column from freezing to the tubes 13.

A container for the ice columns may be disposed under the moulds, so that the ice columns will fall directly into said container to be packaged for storage and transport. The section elements 11, 12 can then be moved together again and a next production cycle can start.

Figure 7:
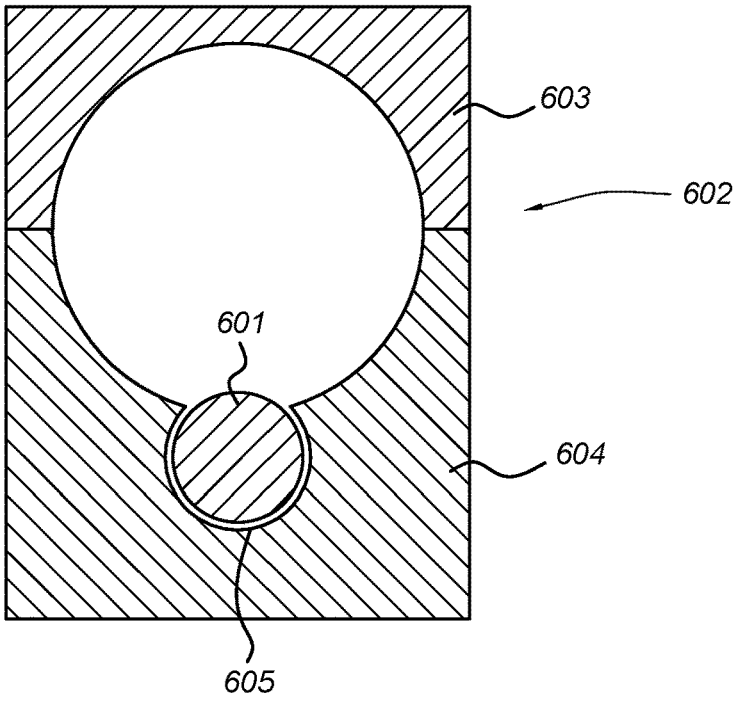
FIG. 7 is a cross sectional view of a mould in closed position, the mould having an elongated element extending through the mould at a side of the mould.
Figure 8:
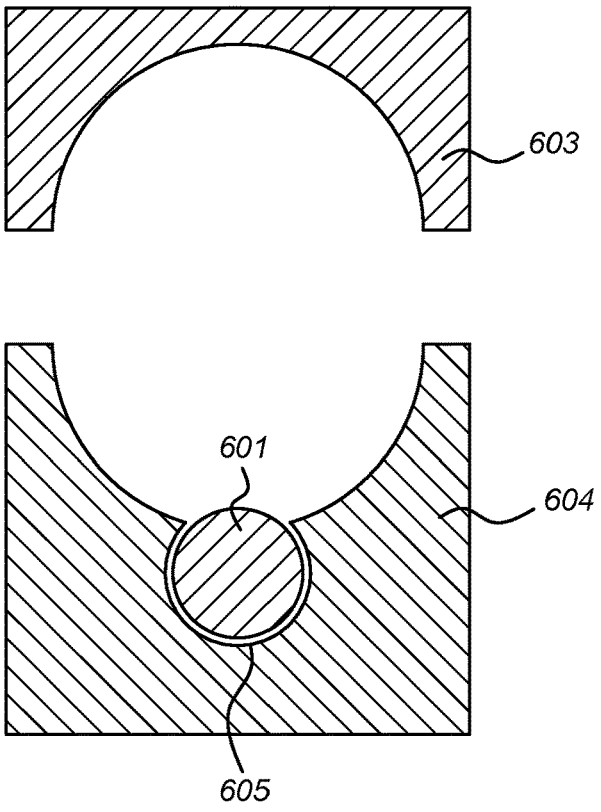
FIG. 8 is a cross sectional view of the mould shown in FIG. 7, in open position.

FIG. 7 shows a diagram of another implementation example. The mould 602 has two mould halves 603 and 604. The tube 601 extends through the mould 602 on the side of the mould 602 rather than in the center of the mould 602. The surface of the mould half 604 has a recess 605, in which the tube 601 is disposed. FIG. 8 shows the same implementation example, in the situation where the mould halves 603 and 604 have been moved apart, so that an ice column formed within the mould 602 can be removed. The tube 601 is configured to rotate around its longitudinal axis. In operation, the surface of the rotating tube 601 contacts the liquid substance. Due to friction between the tube 601 and the liquid substance, the liquid substance also starts moving. For example, the liquid substance starts rotating within a cross section of the mould 602. This way, a clear ice column is generated. For example, the cross section of the mould 602 is (apart from the recess 605) circular. However, the cross section may also have another shape, such as a square or rectangular shape. In an alternative implementation (not shown in the drawing), the tube 602 can be on a side of the mould, but not in any recess of the mould surface, so that the tube 602 may cause a hole in the ice column.

The examples and embodiments described herein serve to illustrate rather than limit the invention. The person skilled in the art will be able to design alternative embodiments without departing from the spirit and scope of the present disclosure, as defined by the appended claims and their equivalents. Reference signs placed in parentheses in the claims shall not be interpreted to limit the scope of the claims. Items described as separate entities in the claims or the description may be implemented as a single hardware or software item combining the features of the items described.

The invention claimed is:

1. An apparatus for making ice cubes, comprising at least one elongated mould that defines a space for an ice column, which space is closed at least while a liquid substance is being refrigerated;

a supplying device for supplying the liquid substance to the at least one elongated mould;

a refrigerating device for freezing the liquid substance inside the at least one elongated mould;

an elongated element configured to extend through said at least one mould in a longitudinal direction of said at least one mould, wherein the elongated element is configured to rotate around a longitudinal axis of the elongated element; and an actuator operatively coupled to the elongated element to control the rotation of the elongated element, wherein the actuator is configured to cause the elongated element to rotate at least during a part of a time during which the liquid substance is being frozen, causing the liquid substance to circulate around the elongated element, wherein an inside surface of the mould comprises a recess recessed from said inside surface at an end of the mould in the longitudinal direction of the mould, wherein the recess is configured to receive a tip of the elongated element, wherein the at least one elongated mould comprises two mould halves, and wherein while the two mould halves are connected, the recess is formed on a surface of a position where the two or more mould halves are connected.

2. The apparatus of claim 1, wherein at least part of an outside surface of the elongated element is coarse, bristly, or uneven.

3. The apparatus of claim 1, wherein the outside surface of the elongated element has at least one protrusion and/or at least one recess and/or is non-cylindrical in cross section.

4. The apparatus of claim 1, further comprising a temperature sensor to detect a temperature of the mould, wherein the actuator is configured to cause the elongated element to rotate at a first rotation speed when the detected temperature is above zero degrees Celsius, and at a second rotation speed when the detected temperature is below zero degrees Celsius, wherein the second rotation speed is higher than the first rotation speed.

5. The apparatus of claim 1, wherein a wall of the mould at an end of the mould in the longitudinal direction, comprises an orifice through which the elongated element is configured to extend.

6. The apparatus of claim 5, wherein the orifice in the wall of the mould is at least partly covered with a flexible solid material.

7. The apparatus of claim 5, wherein the actuator is mechanically coupled to a portion of the elongated element, which portion extends from the mould.

8. The apparatus of claim 5, wherein the orifice is at a top of the mould.

9. The apparatus of claim 1, wherein at least one wall of the mould comprises at least part of the refrigerating device.

10. The apparatus of claim 1, wherein at least part of an inside surface of the mould comprises a metal.

11. The apparatus of claim 1, wherein said at least one mould defines a series of interconnected, hollow spaces for forming an elongated ice column of interconnected ice cubes, or wherein the apparatus comprises a plurality of moulds which are oriented in a matrix relative to each other.

12. The apparatus of claim 1, wherein the recess is at a bottom of the mould.

13. The apparatus of claim 1, further comprising an actuator operatively coupled to the elongated element to control the rotation of the elongated element.

14. The apparatus of claim 13, wherein the actuator is configured to cause the elongated element to rotate at least during a part of a time during which the liquid substance is being frozen.

15. The apparatus of claim 14, wherein the actuator is configured to continue causing the elongated element to rotate after the freezing is completed.

16. A method of making ice cubes, comprising supplying a liquid substance to at least one elongated mould that defines a space for an ice column, which space is closed at least while the liquid substance is being refrigerated;

freezing the liquid substance inside the at least one elongated mould, while rotating an elongated element extending through the mould in a longitudinal direction of the mould around a longitudinal axis of the elongated element, wherein the elongated element rotates at least during a part of a time during which the liquid substance is being frozen, causing the liquid substance to circulate around the elongated element, wherein an inside surface of the mould comprises a recess recessed from said inside surface at an end of the mould in the longitudinal direction of the mould, wherein the recess is configured to receive a tip of the elongated element, wherein the at least one elongated mould comprises two or more mould halves, and wherein while the two mould halves are connected, the recess is formed on a surface of a position where the two mould halves are connected; and removing the ice column thus formed from the mould.

17. The method of claim 16, wherein the recess is at a bottom of the mould.

* * * * *